US012709462B2

(12) United States Patent
Kubek et al.

(10) Patent No.: US 12,709,462 B2
(45) Date of Patent: Aug. 18, 2026

(54) PANEL BOX ATTACHMENT FOR A FLUID STORAGE TANK

(71) Applicant: HydrEra Water Services LLC, South Bend, IN (US)

(72) Inventors: Danny Kubek, Weatherford, TX (US); William Logsdon, Firestone, CO (US)

(73) Assignee: HydrEra Water Services LLC, South Bend, IN (US)

( * ) Notice: Subject to any disclaimer, the term of this patent is extended or adjusted under 35 U.S.C. 154(b) by 32 days.

(21) Appl. No.: 18/903,646

(22) Filed: Oct. 1, 2024

(65) Prior Publication Data

US 2025/0100789 A1 Mar. 27, 2025

Related U.S. Application Data

(62) Division of application No. 18/582,372, filed on Feb. 20, 2024, now Pat. No. 12,162,675.

(60) Provisional application No. 63/540,020, filed on Sep. 22, 2023.

(51) Int. Cl.
*B65D 88/52* (2006.01)
*E21B 43/26* (2006.01)

(52) U.S. Cl.
CPC ..... *B65D 88/528* (2013.01); *E21B 43/2607* (2020.05)

(58) Field of Classification Search
CPC ... B65D 7/12; B65D 7/02; B65D 7/04; B65D 7/045; B65D 7/1637; B65D 88/706; B65D 88/528; B65D 90/08; F24H 1/181; F24H 1/18; F24H 1/183; E21B 43/2607
See application file for complete search history.

(56) References Cited

U.S. PATENT DOCUMENTS

| | | | | |
|---|---|---|---|---|
| 3,556,351 | A | 1/1971 | Williams | |
| 4,036,390 | A * | 7/1977 | Morse | B65D 90/08 220/565 |
| 4,057,295 | A | 11/1977 | Liet | |
| 5,551,797 | A | 9/1996 | Sanford | |
| 6,039,201 | A | 3/2000 | Kesterman et al. | |
| 6,171,029 | B1 | 1/2001 | McGill et al. | |
| 9,248,960 | B2 | 2/2016 | Avery | |
| 9,284,113 | B2 | 3/2016 | Corbell | |
| 9,315,318 | B2 | 4/2016 | Allen | |
| 9,816,320 | B1 * | 11/2017 | Herrick | H02G 1/06 |
| 10,239,687 | B1 | 3/2019 | Haskins | |

(Continued)

FOREIGN PATENT DOCUMENTS

| | | |
|---|---|---|
| CA | 2692016 | 7/2010 |
| CN | 204371419 U | 6/2015 |

(Continued)

*Primary Examiner* — Kareen K Thomas
(74) *Attorney, Agent, or Firm* — William W. Cochran; Cochran Freund & Young LLC

(57) ABSTRACT

Disclosed is a tank that retains a large amount of fluid in a safe manner. The tank can be easily and rapidly constructed and disassembled for subsequent use. A liner has lifting straps that are lifted by winch booms connected to booms. Exterior securing straps are used to hold the liner in place. Connecting plates are secured to trunnions on each of the panels. Pressure pins allow the connector plates to flex so that the panels can form a round or oval tank. The panels are constructed in a curved fashion to create the round or oval tank wall.

6 Claims, 21 Drawing Sheets

(56) References Cited

U.S. PATENT DOCUMENTS

| | | | | |
|---|---|---|---|---|
| 11,059,666 | B2 | 7/2021 | Lanigan et al. | |
| 2007/0041789 | A1 | 2/2007 | Monroe et al. | |
| 2011/0024435 | A1 | 2/2011 | MacNabb | |
| 2011/0194893 | A1 | 8/2011 | Wiebe | |
| 2012/0309604 | A1 | 12/2012 | Wiebe | |
| 2013/0098906 | A1 | 4/2013 | Lovelace | |
| 2013/0186890 | A1 | 7/2013 | Moody et al. | |
| 2013/0333195 | A1 | 12/2013 | Hanna | |
| 2013/0336756 | A1 | 12/2013 | Hanna | |
| 2017/0253427 | A1 | 9/2017 | Hindbo | |
| 2018/0208392 | A1 | 7/2018 | Hindbo | |
| 2023/0085100 | A1* | 3/2023 | Akey | B25J 11/0055 83/39 |
| 2024/0123534 | A1* | 4/2024 | Akey | B23K 9/0953 |

FOREIGN PATENT DOCUMENTS

| | | |
|---|---|---|
| EP | 0523389 | 1/1993 |
| KR | 100756294 | 9/2007 |
| KR | 2021-0046315 | 4/2021 |
| WO | WO-2017011899 | 1/2017 |

* cited by examiner

PANEL BOX ATTACHMENT FOR A FLUID STORAGE TANK

CROSS-REFERENCE TO RELATED APPLICATIONS

The present U.S. Utility Patent Application claims priority pursuant to 35 U.S.C. § 120 as a divisional of U.S. Utility patent application Ser. No. 18/582,372, entitled, "A LARGE FLUID STORAGE TANK," filed on Feb. 20, 2024, which claims priority pursuant to 35 U.S.C. § 119(e) to U.S. Provisional Application No. 63/540,020, entitled, "TANK FOR FRACKING FLUID," filed on Sep. 22, 2023, both of which are incorporated herein by reference for all that they disclose and teach and are made part of the present U.S. Utility Patent Application for all purposes.

BACKGROUND OF THE INVENTION

Advancements have been made in recent years in oil well drilling and extraction technology that maximize the extraction process for oil wells. One of those advances relates to fracking technology, in which a fracking liquid is pumped downhole under high pressure to frack areas underground that are capable of producing oil. The fracking typically occurs at a depth of one mile or greater underground, so that the fracking does not affect water tables or areas where drinking water is extracted.

The fracking process requires a fracking liquid that typically comprises water and possibly other chemicals that assist in the fracking process. It is beneficial to maintain the fracking liquid above ground in water-tight containers so that the fracking liquid does not escape above ground and possibly cause contamination. Since hundreds of thousands of gallons are used in the fracking process, these water-tight containers are tanks that must be very large and capable of containing fluids without leakage.

Various other uses for large fluid storage tanks exist for various applications. For example, an inexpensive and quickly constructed water storage tank can be useful for municipal water storage and distribution, especially, but not limited to, emergency water storage. Manufacturing plants and processing facilities may use large liquid storage facilities for industrial fluid management for hydrotesting oil, gas, water pipelines, and their constituent parts. Another area, of course, is the resource development projects that require fluid containment for fracking and other similar processes, such as drilling and production operations. Environmental remediation, including the containment of hazardous fluids created by natural disasters, storage of potable water during a natural disaster, and use of water and fire remediation fluids for firefighting. Other uses include water storage for agricultural irrigation and distribution and drought areas or where there has been an infrastructure disruption that prevents proper distribution and storage of water.

These are only a few of the disparate and widespread applications of water storage systems and storage of other fluids, including hazardous liquids, in which the disclosed invention can be utilized.

SUMMARY OF THE INVENTION

An embodiment of the present invention may therefore comprise: a method of storing fluid comprising: forming a tank wall with curved steel panels by connecting the steel panels with connector plates; placing a manifold that is recessed in the ground below the tank wall so that outer ports and manifold valves are located outside of the tank wall and inner ports are located inside the tank wall; placing a liner inside the tank wall using at least two booms that attach cables from spreader bars to a plurality of lifting straps located on an inner portion of the liner; attaching the inner ports to the liner with watertight gaskets so that an inner portion of the liner is connected to the outer ports allowing the fluid to be filled and drained in the tank; using a winch on the at least two booms to simultaneously lift the liner on the tank wall so that at least one section of the liner extends over a top portion of the tank wall; attaching securing straps on the liner to an outer portion of the tank wall to secure the liner to the tank wall.

An embodiment of the present invention may therefore further comprise: a method of constructing a tank wall comprising: providing curved panels that have a panel box located on the panel at a location proximate to a center of gravity of the panel; securing a panel box attachment to a boom, the panel box attachment configured to attach to the panel box; lifting the curved panels one at a time and placing the curved panels in a rounded tank wall; attaching the curved panels to each other using connector plates that are placed over trunnions attached to the curved panels using pressure pins inserted through openings in the trunnions.

An embodiment of the present invention may therefore further comprise: a tank for storing fluid comprising: a tank wall formed from curved steel panels that are connected together with connector plates; a manifold that is recessed below ground level and below the tank wall, the manifold having outer ports that are located outside of the tank wall and inner ports that are located inside the tank wall; a liner disposed inside the tank that has lifting straps inside the liner and securing straps located along an outer edge of the liner, the securing straps attached to an outside portion of the tank wall to hold the liner in place in the tank; at least two winches connected to at least two booms that are configured to raise the liner inside the tank wall.

An embodiment of the present invention may therefore further comprise: a panel box attachment that is configured to attach to a panel box on a tank panel comprising: a panel box plate; at least two fixed pins attached to the panel box plate; at least two retractable panel box pins that can be moved to extend outwardly from the panel box pin and inwardly to a retracted position in the panel box plate; a pivot cylinder that is attached to the panel box plate to pivot the panel box plate.

DETAILED DESCRIPTION OF THE EMBODIMENTS

Figure 1:
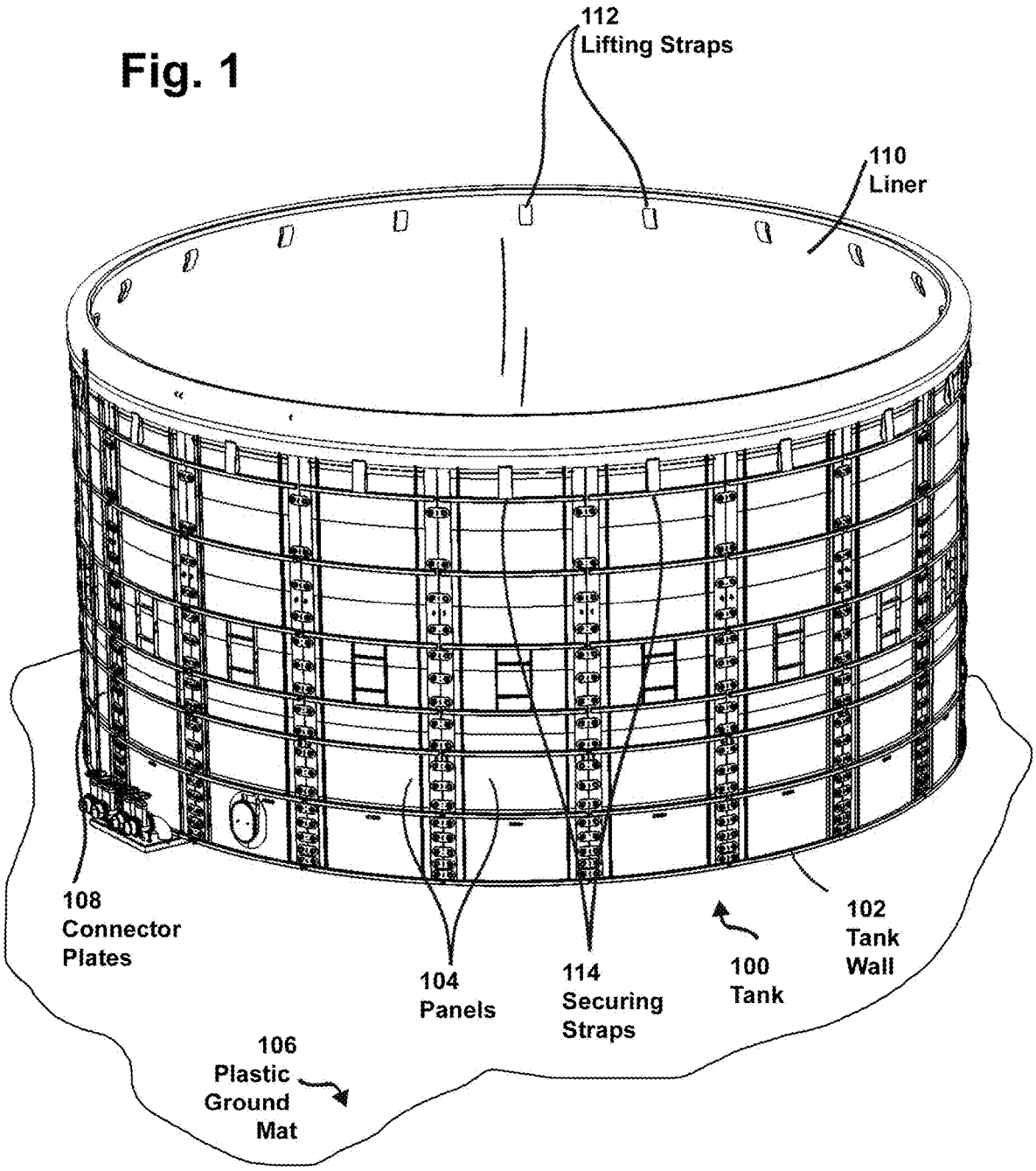
FIG. 1 is a schematic illustration of an embodiment of a tank for holding fracking fluid.

FIG. 1 is a schematic isometric view of a tank 100 that is capable of storing a large quantity of fluid. As illustrated in FIG. 1, the tank 100 has a tank wall 102 that is constructed from a plurality of panels 104 that are connected together. The structure illustrated in FIG. 1 is placed on a plastic ground mat 106 on a generally flat and level area. The plastic ground mat 106 captures any leakage from the tank 100 so as to not be absorbed by the ground. The panels 104 are connected by a plurality of connector plates 108. The tank wall 102 is covered on an interior portion by a liner 110 which is impervious to liquids. The liner 110 fits within the tank wall 102 to contain the fluid. In one embodiment, the fluid may be a fracking fluid for fracking oil wells. Lifting straps 112 are used to lift the liner into place on the tank wall 102. Lifting straps 112 are connected to a boom having a winch to raise the liner using spreader bars, as disclosed in more detail below in FIG. 19.

Figure 2:
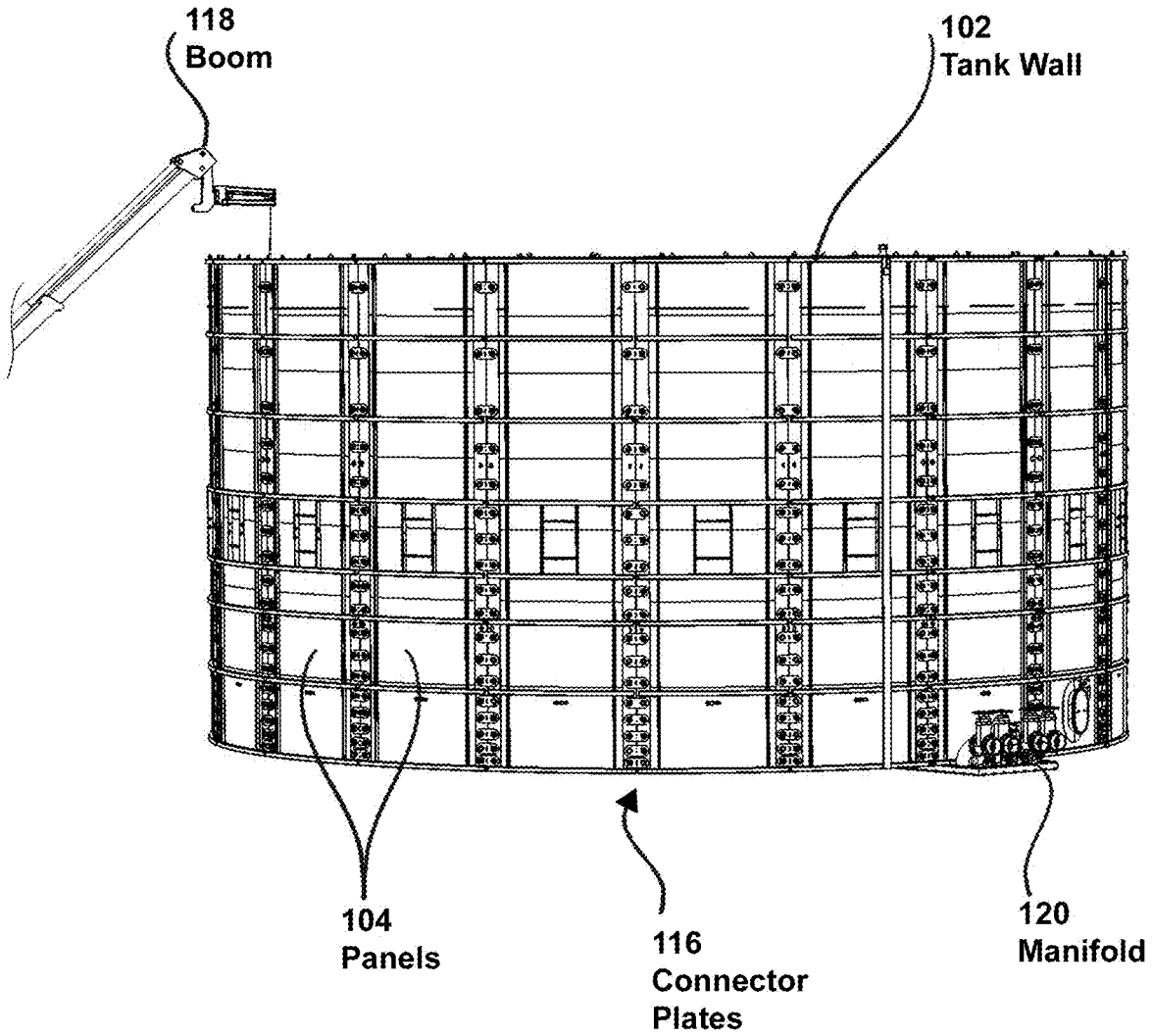
FIG. 2 is a schematic illustration of an embodiment of FIG. 1, showing a tank wall made from panels.

FIG. 2 is a side view of the tank wall 102 that includes a number of panels 104 to form the tank wall 102. The panels 104 are connected in a circular fashion using connector plates 116. Manifold 120 is located at the edge of the tank wall 102. FIG. 2 also illustrates a boom 118 that is used to lift a liner (FIG. 3) over the tank wall 102.

Figure 3:
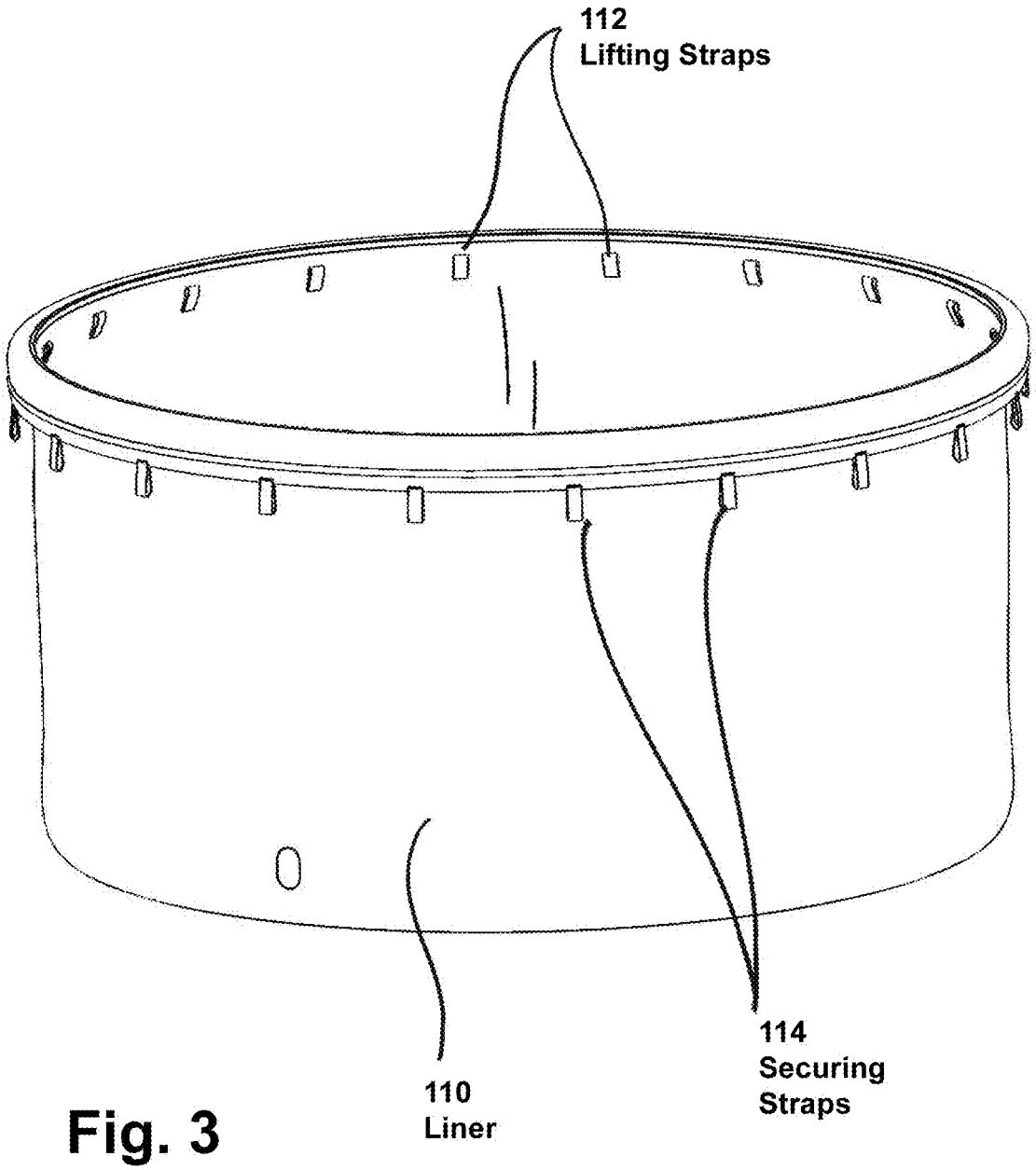
FIG. 3 is a schematic illustration of a liner that is placed inside the tank walls of the embodiment of FIG. 2.

FIG. 3 is a schematic view of liner 110 that is placed within the tank wall 102. Liner 110 includes a series of lifting straps 112 that are connected to the boom 118 (FIG. 2) that lifts the liner 110 along the side of the tank wall 102 (FIG. 2). The liner is lifted and curled over the top of the tank wall 102 so that securing straps 114 can be secured to the outside of the tank wall 102.

Figure 4:
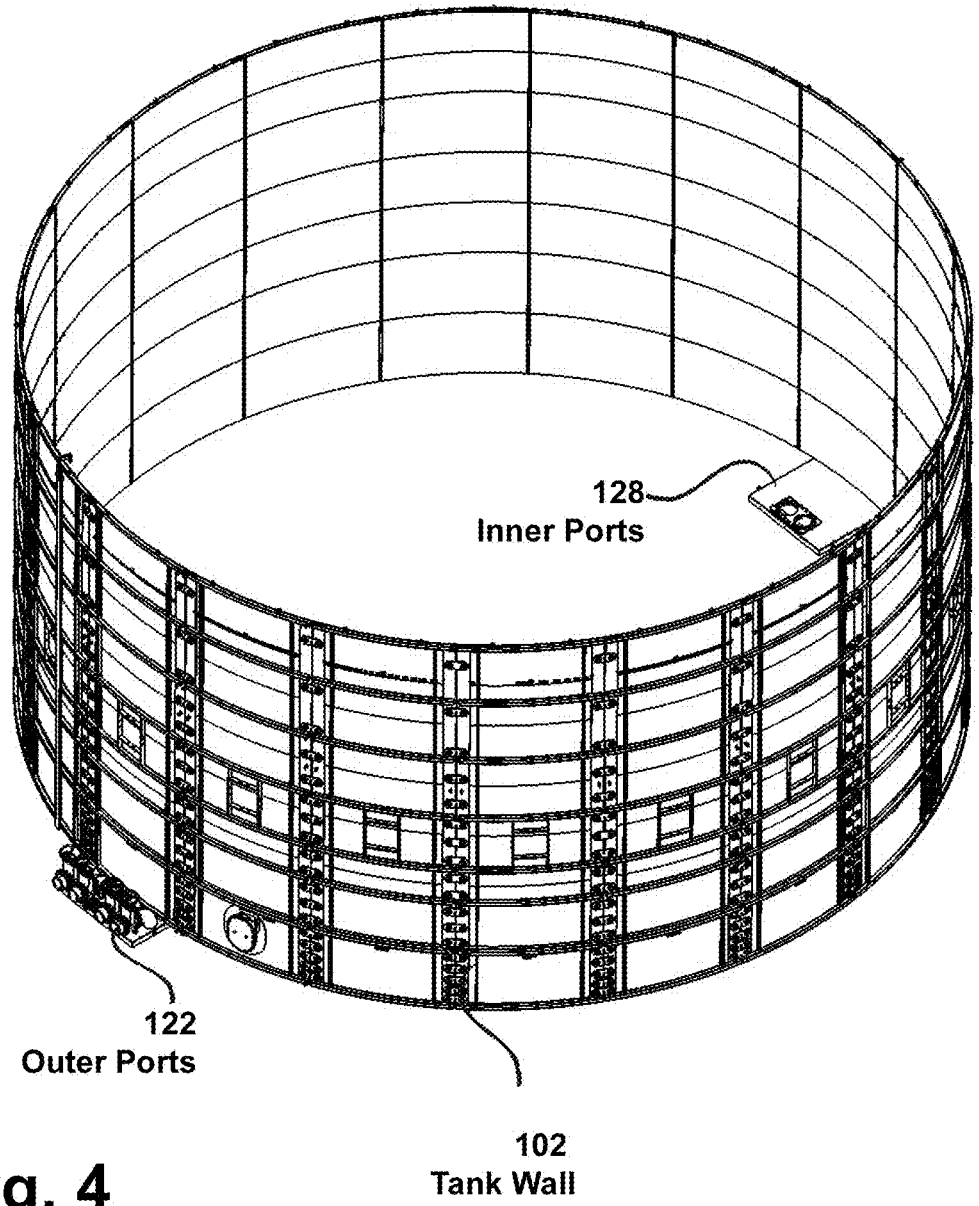
FIG. 4 is a schematic illustration of an embodiment of tank walls constructed from panels and a manifold.

FIG. 4 is an elevated view of the tank wall 102. As shown in FIG. 4, two manifolds are provided on opposite sides of the tank wall 102. Outer ports 122 are connected to inner ports that cannot be seen in FIG. 4. Similarly, inner ports 128 are connected to outer ports which cannot be viewed in FIG. 4.

Figure 5:
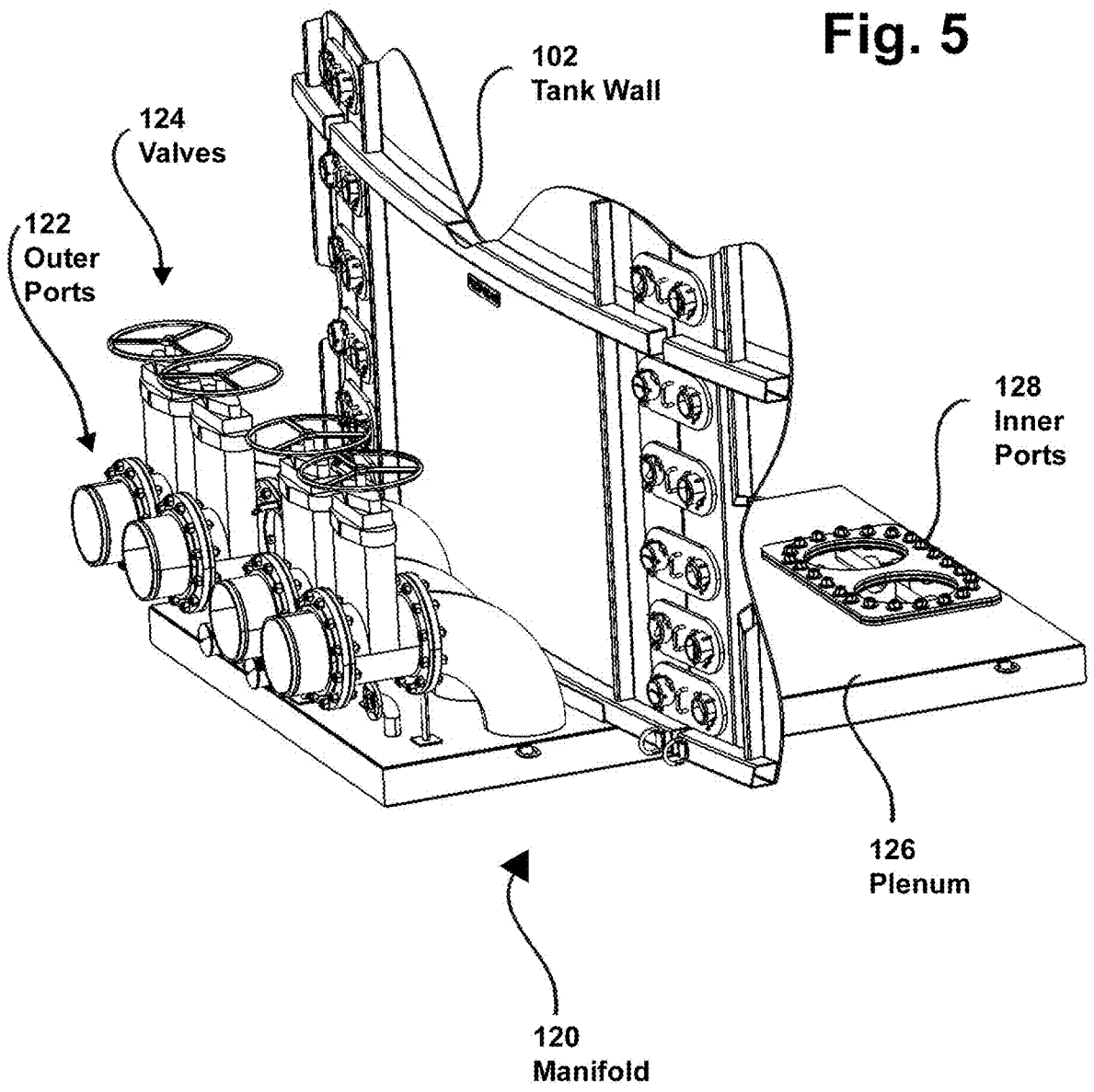
FIG. 5 is a schematic illustration of an embodiment of a manifold located on a tank wall.

FIG. 5 is a schematic illustration of a manifold 120 that is used to fill and drain the tank 100 with fluid. Again, the fluid may be water, hazardous fluid, fracking fluid, etc. The outer ports 122 and valves 124 are located outside of the tank wall 102. Fluid can be transmitted through the outer ports 122 to the inner ports 128 through the plenum 126 to fill the tank. When the tank needs to be drained, valves 124 are opened and fluid flows through the outer ports 122 for disposal. As illustrated in FIG. 5, there are four outer ports 122 and four associated valves 124. If desired, fracking chemicals can be introduced through one or more valves while water is introduced through the other valves. In this manner, a premixing of the fracking chemicals are not necessary since the fracking chemicals can be separately introduced via the outer ports 122. As illustrated in FIG. 5, plenum 126 may be recessed in the ground so that the tank wall 102 is placed on top of the plenum 126 and the tank wall 102 is disposed at ground level. Manifold 120 is further disclosed in U.S. Pat. No. 10,239,687, issued Mar. 26, 2019 to Isaac Haskins, and owned by the assignee of the present application, which is specifically incorporated herein, by reference, for all that it discloses and teaches.

Various other chemicals and additives can be inserted into the fluid in the tank through the connection of the manifolds. For example, chemicals and other additives can be used for the purposes of preservation, testing and analysis, treatment, pH adjustment and composition modification, as well as many other purposes. Since the tank can be used for a variety of different applications, additives and chemicals can be used for each of those particular applications. Accordingly, chemicals can be added to prevent biological growth or degradation of the fluid to preserve the fluid. In this case, biocides can be mixed in the water storage to prevent bacterial or algae growth. As another example, corrosion inhibitors can be added to the fluid in the tank to protect storage container parts and pipelines from corroding due to the chemical properties of the stored fluid. Also, the pH level of the fluid can be adjusted by addition of chemicals and various compounds to obtain a desired level of pH, which can be important for maintaining the stability and effectiveness of certain fluids. Chemical additives can also be used to facilitate testing and analysis of stored fluid. For example, tracer chemicals can be added to track the movement of fluids within the storage system. Chemical additives may also be used to modify the composition of the stored fluid for specific purposes, such as enhancement performance or meeting regulatory requirements. In some cases, chemicals or other additives can be added to adjust the density of the fluid for various operational or processing needs. Chemicals and other additives can be added to control or mask odor associated with stored fluids. These are only a few of the examples of various additives and chemicals that can be inserted into the fluid through one of the manifolds 120 (FIG. 5).

Figure 6:
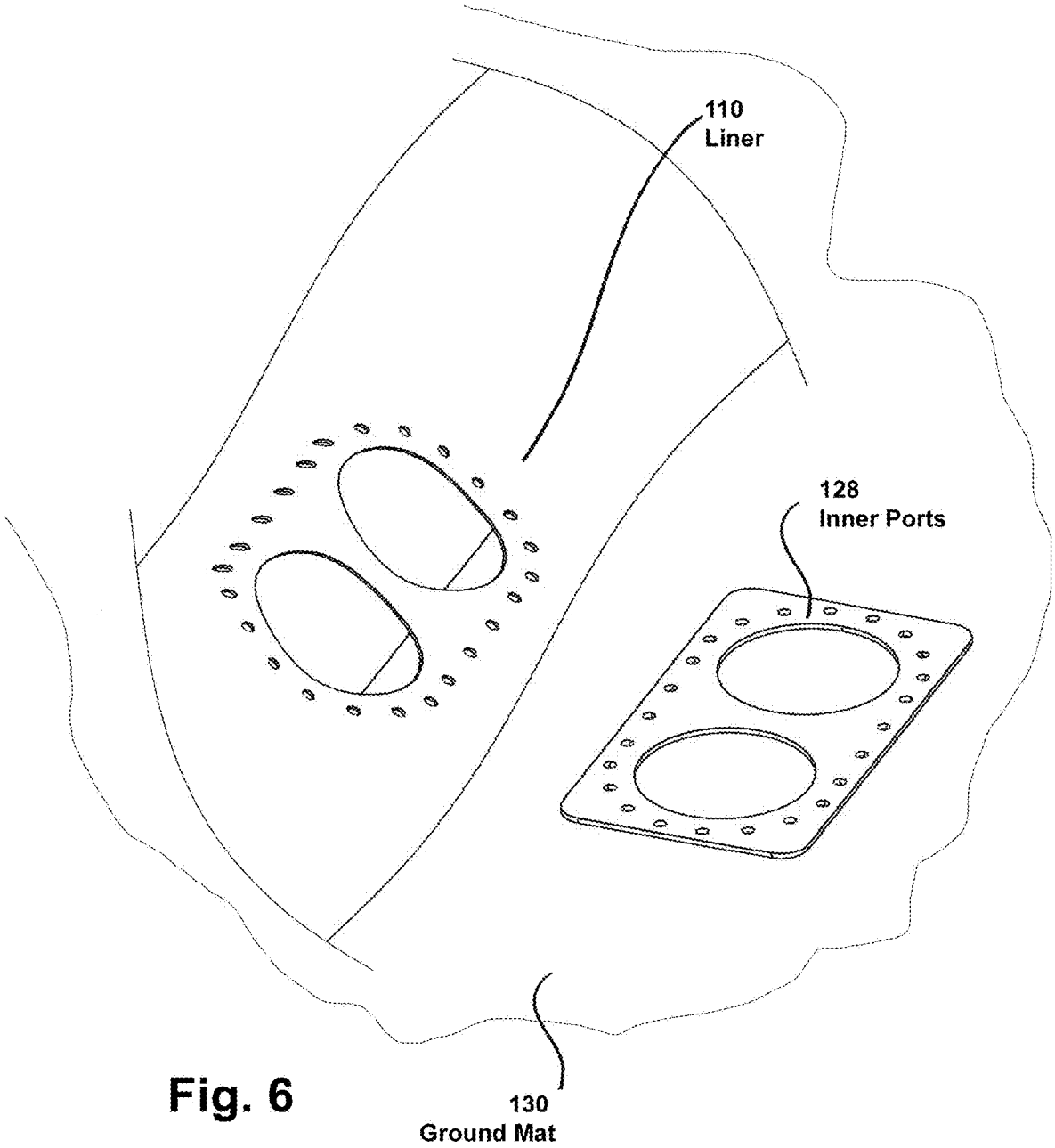
FIG. 6 is a schematic illustration of an embodiment of inner ports of the manifold located inside of a tank.

FIG. 6 is an isometric view of the inner ports 128 that protrude through the plastic ground mat 130. The liner 110 has openings that match the openings of the inner ports 128. The liner 110 is then placed over the inner ports 128 and secured to the inner ports 128 to prevent leaks.

Figure 7:
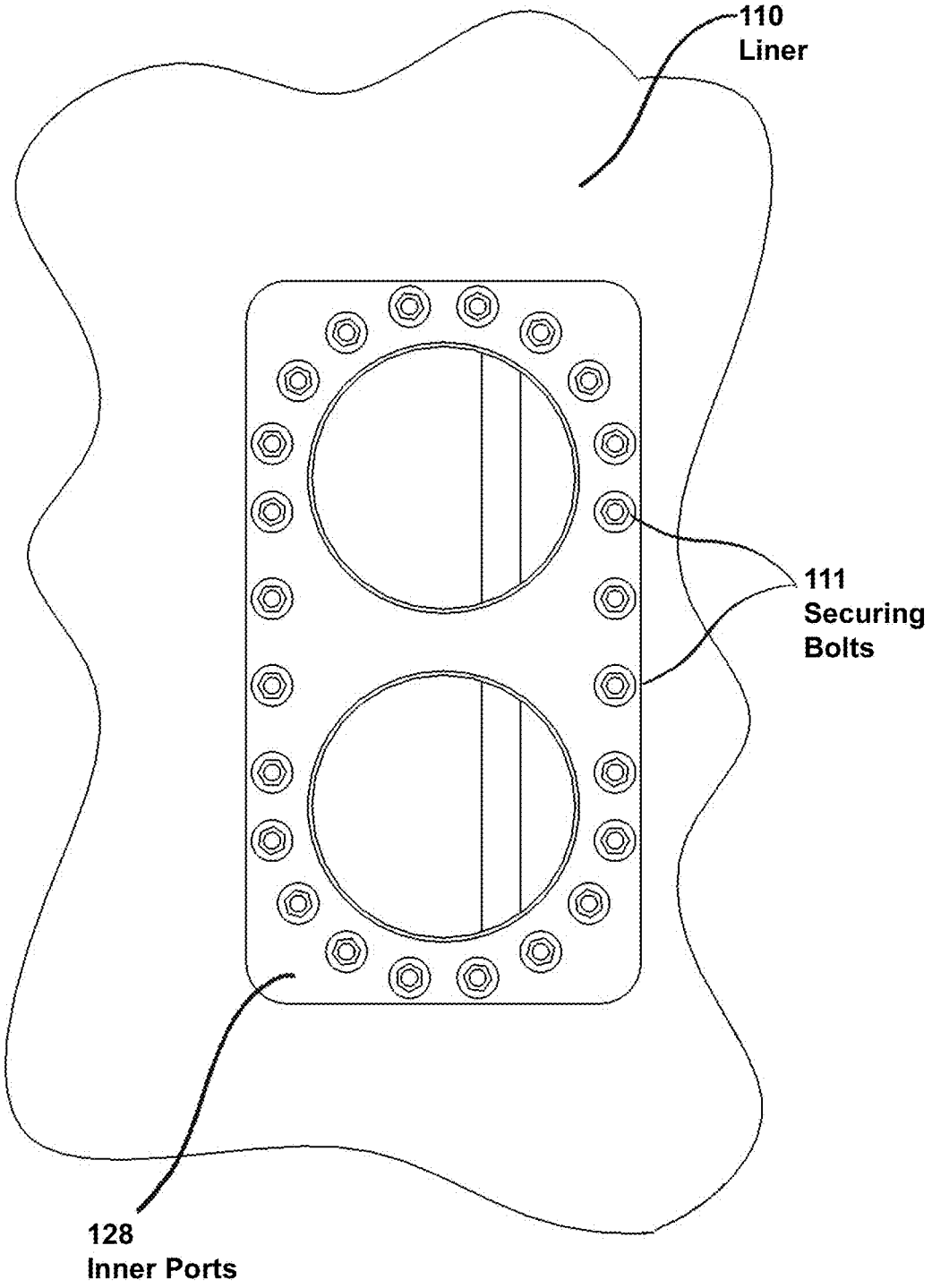
FIG. 7 is a schematic illustration of an embodiment of inner ports that are secured to a liner inside of a tank.

FIG. 7 is an illustration of a liner 110 secured to the inner ports 128 using securing bolts 111. A gasket, not shown, is placed between the liner 110 and the inner ports 128 to prevent leakage.

Figure 8:
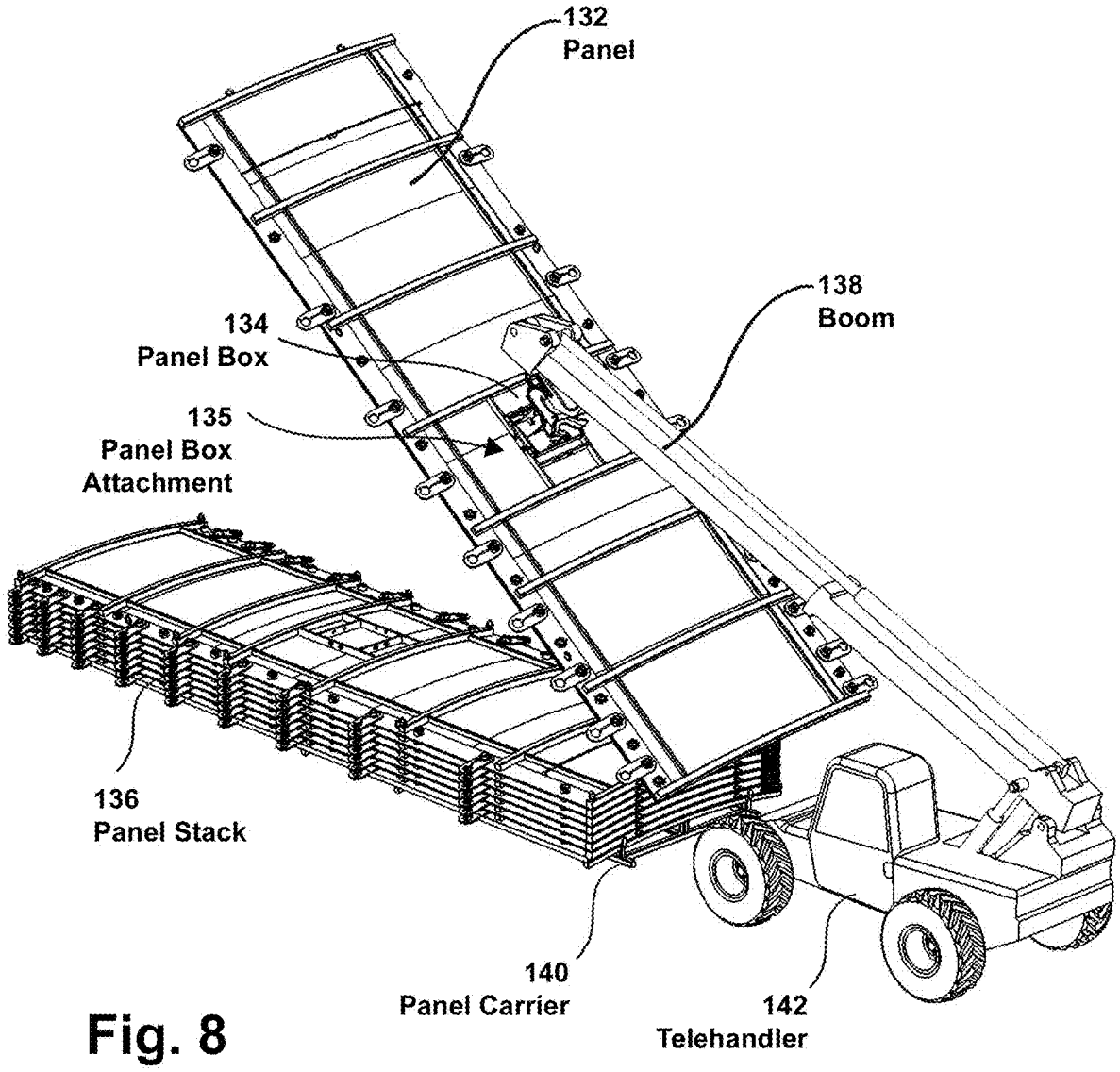
FIG. 8 is a schematic illustration of an embodiment of a boom lifting a panel.

FIG. 8 discloses a series of panels in a panel stack 136. Boom 138 is connected to a panel box attachment 135, which, in turn, is connected to the panel box 134 on panel 132. The boom on telehandler 142 is capable of lifting the panel 132 from the panel stack 136. Since the panel box 134 is located at the center of gravity of the panel 132, the panel box attachment 135 can be connected to the panel box 134 at either end or either side of the panel stack 136. In this manner, the telehandler 142 can lift the panel 132 from the stack 136 and transport the panel 132 for connection to the tank wall 102. FIG. 8 also illustrates a panel carrier 140 as used for transporting the panel stack 136.

Figure 9A:
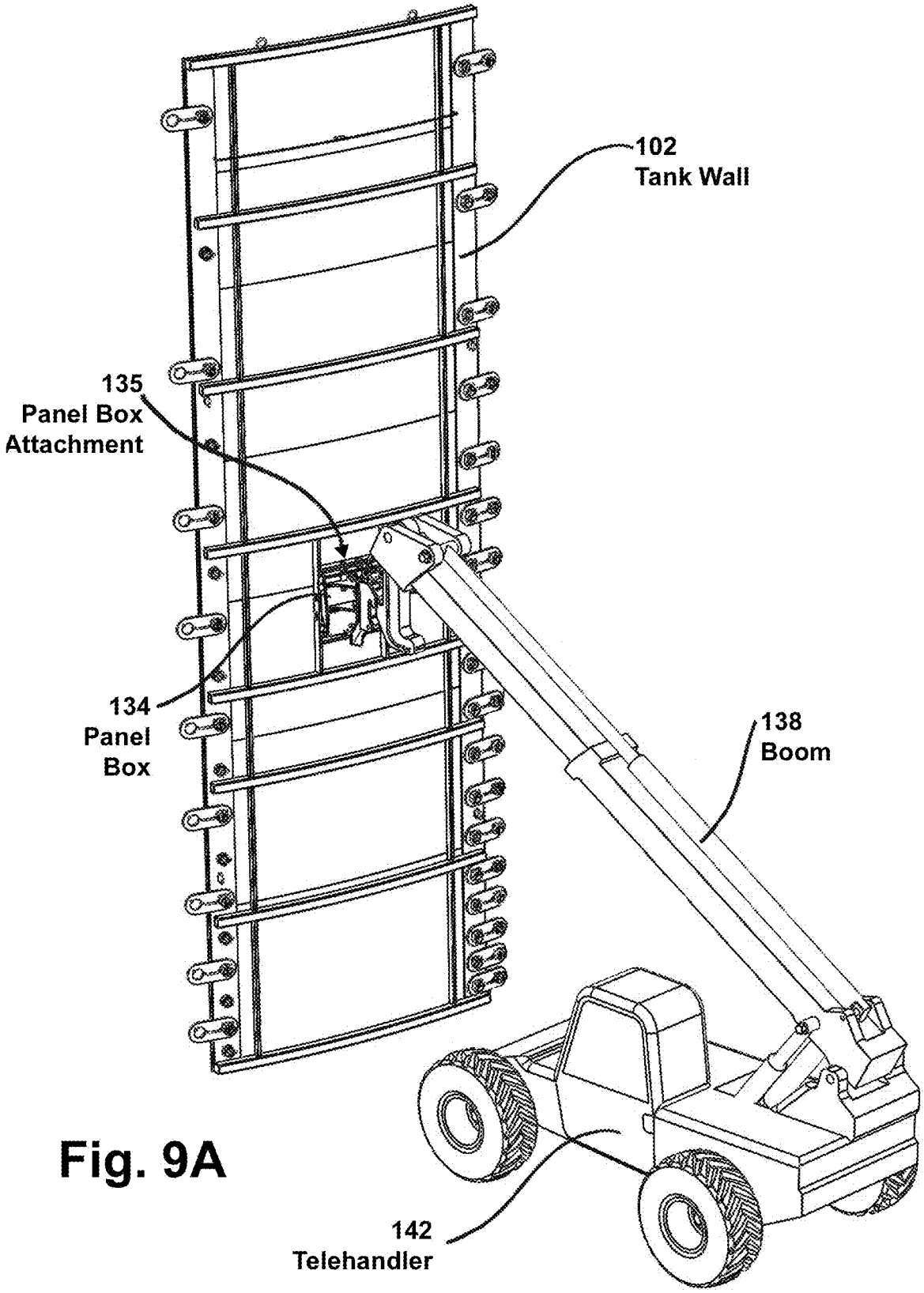
FIG. 9A is a schematic illustration of an embodiment of an embodiment of a telehandler moving a panel.

FIG. 9A is an illustration of a telehandler 142 transporting a panel 132. The telehandler 142 has a boom 138 with a panel box attachment 135 connected to the end of the boom. The panel box attachment 135 connects to a panel box on the panel 132 that is located at the center of gravity of the panel 132 to ease in the lifting process and transportation of the panel 132. The panel box attachment 135 is secured to the end of the boom 138 and can be easily disconnected from the panel box after the panel 132 is secured to the tank wall.

Figure 9B:
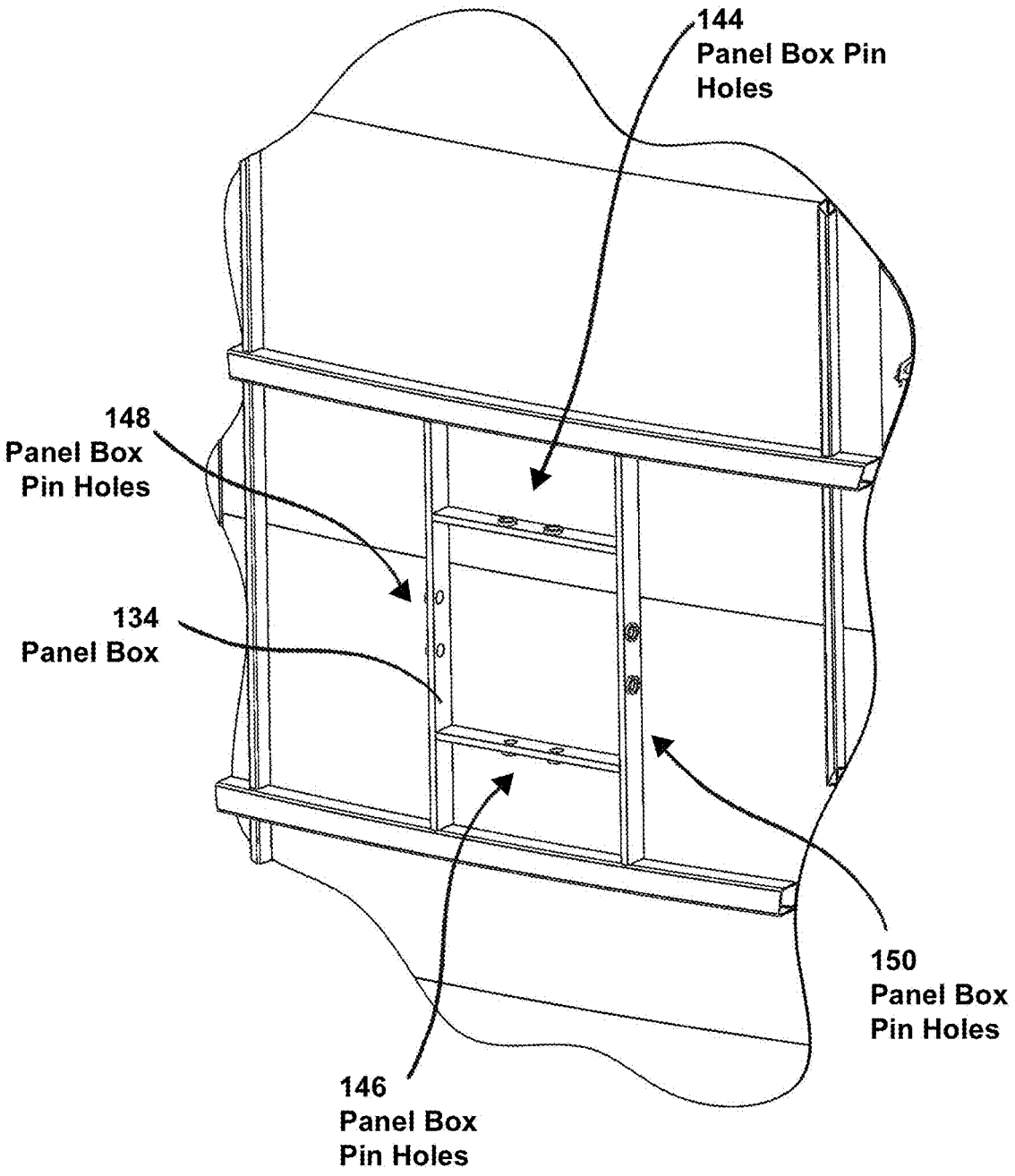
FIG. 9B is a schematic illustration of an embodiment of a panel box located on a panel.

FIG. 9B is an isometric cutaway view of the panel box 134 located on panel 132. As illustrated in FIG. 9B, the panel box is formed from a support structure on the panel 132. The panel box 134 includes panel box pin holes 144 and panel box pin holes 146 on the top and bottom of the panel box. In addition, panel box pin holes 148, 150 are located on the side structures. These pin holes are spaced by the same amount and placed at a distance spaced from the center of the panel box 134 so that both the fixed pins and the panel box pins can be inserted in any of the four directions of the panel 132 so that the panel 132 can be lifted from the top, bottom, or either side. This is explained in more detail in FIGS. 13-17.

Figure 10:
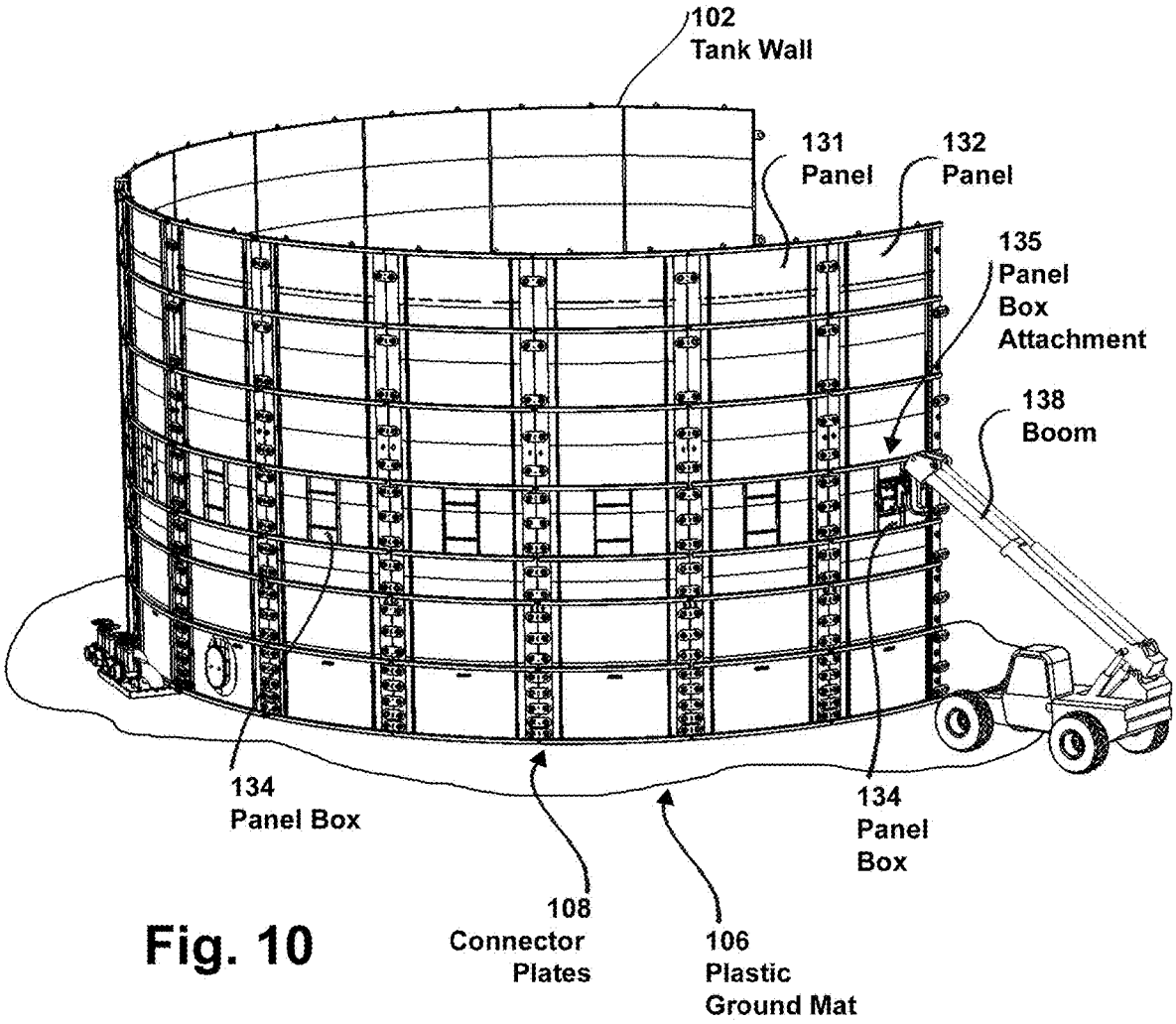
FIG. 10 is a schematic illustration of an embodiment of a panel being placed on a tank wall with a boom.

FIG. 10 is a schematic elevated isometric illustration of a panel 132 being placed on a tank wall 102. As shown in FIG. 10, the boom 138 moves the panel 132 adjacent the tank wall 102. The panel 132 is placed along a painted line along the ground or plastic ground cover 106 (FIG. 1) so that the panel 132 is properly placed to form a circular tank. Prior to assembling the panels of the tank wall 102, a plastic ground mat 106 is placed on a flat, level ground area. The center where the tank is going to be placed is marked and then a string or other device is attached to the center point and the string is rotated around the center point at the desired radius so that the placement of the walls can be marked. Each of the panels are then placed along the marked edge of the tank and attached to an adjacent panel. As shown in FIG. 10, the boom 138 has a panel box attachment 135 that attaches to the panel box 134 on panel 132 and places the panel 132 on the marked plastic ground mat 106. The connector plates 108 are then attached to the adjacent panel 131. As illustrated in FIG. 10, each of the panels has a panel box such as panel box 134. A manlift is used to allow workers to connect the upper connector plates while the lower connector plates can be connected between panel 132 and panel 131 by workers at ground level. As illustrated in FIG. 10, a greater number of connector plates 108 are used on lower portions of the tank wall 102, since greater forces are created at lower levels due to the depth of the water within the tank.

Figure 11:
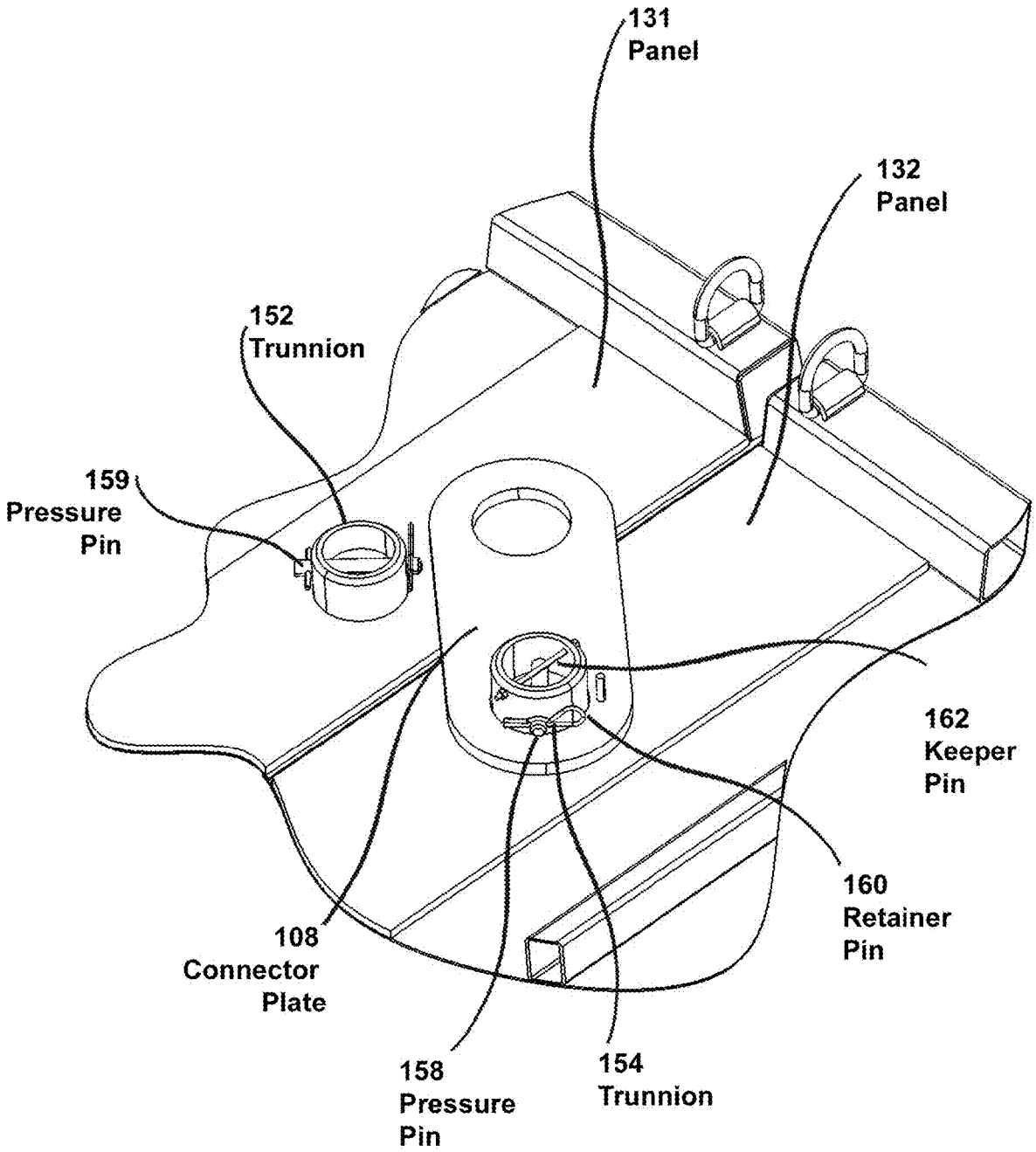
FIG. 11 is a schematic illustration of an embodiment of a connector plate and trunnions used to connect panels.

FIG. 11 is a partial view of a connector plate 108 and the manner of which connector plate 108 is secured to trunnions 152, 154. As shown in FIG. 11, the connector plate 108 is initially attached to panel 132. An adjacent connector plate is connected to panel 131. A pressure pin 158 is disposed in openings of trunnion 154 and holds the connector plate 108 in place on the panel 132. The pressure pin 158 is removed and the connector plate 108 has sufficient room to rotate so that the opening on the connector plate 108 can be placed over trunnion 152. The connector plate 108 remains on trunnion 154 by way of keeper pin 162, which does not allow the connector plate 108 to disengage from trunnion 154, but while still allowing the connector plate 108 to be rotated and moved outwardly so that the connector plate 108 can be disposed over and onto trunnion 152. Pressure pin 158 can then be disposed in trunnion 154 to tightly secure the connector pin 108 to trunnion 154. Similarly, another pressure pin (not shown) is inserted through trunnion 152 to hold the connector place 108 securely to trunnion 152. The pressure pins, such as pressure pin 158, are made from a high strength steel that allows large pressures to be applied while still maintaining the connector plate 108 on trunnion 154.

Figure 12:
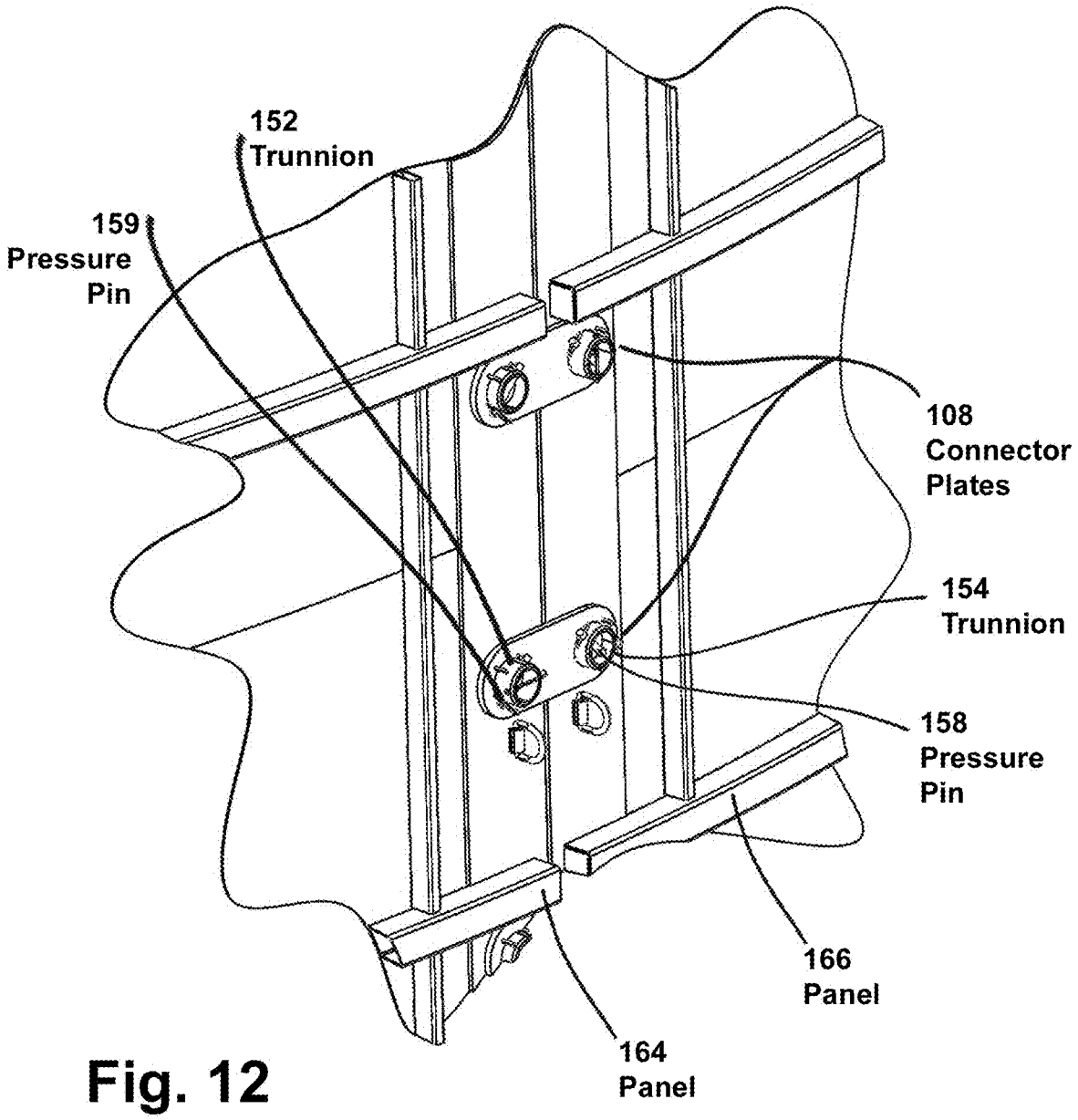
FIG. 12 is an illustration of an embodiment of connector plates that connect panels.

FIG. 12 illustrates connector plate 108 secured to both trunnion 152 and trunnion 154. As illustrated in FIG. 12, the connector plate is placed over trunnion 152 and a pressure pin 159 is inserted through the trunnion 152 over the connector plate 108. Similarly, pressure pin 158 is secured to trunnion 154 which secures a connector plate 108 to trunnion 154. Again, the pressure pins are made of a high tensile strength steel to withstand the forces created on the connector plate 108 when the tank is filled with fracking fluid.

Figure 13:
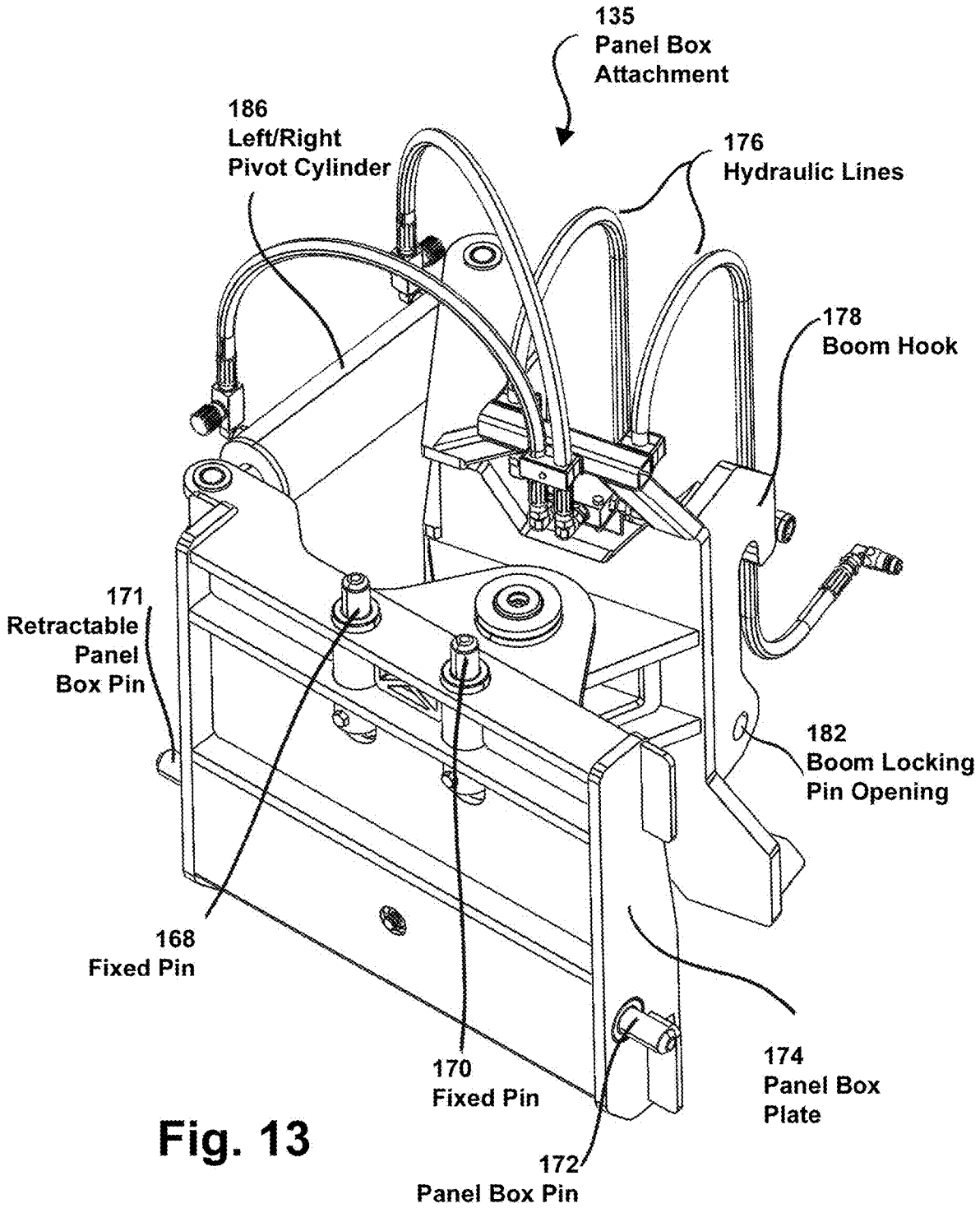
FIG. 13 is a schematic illustration of an embodiment of a quick attach mechanism for moving panels with a boom.
Figure 14:
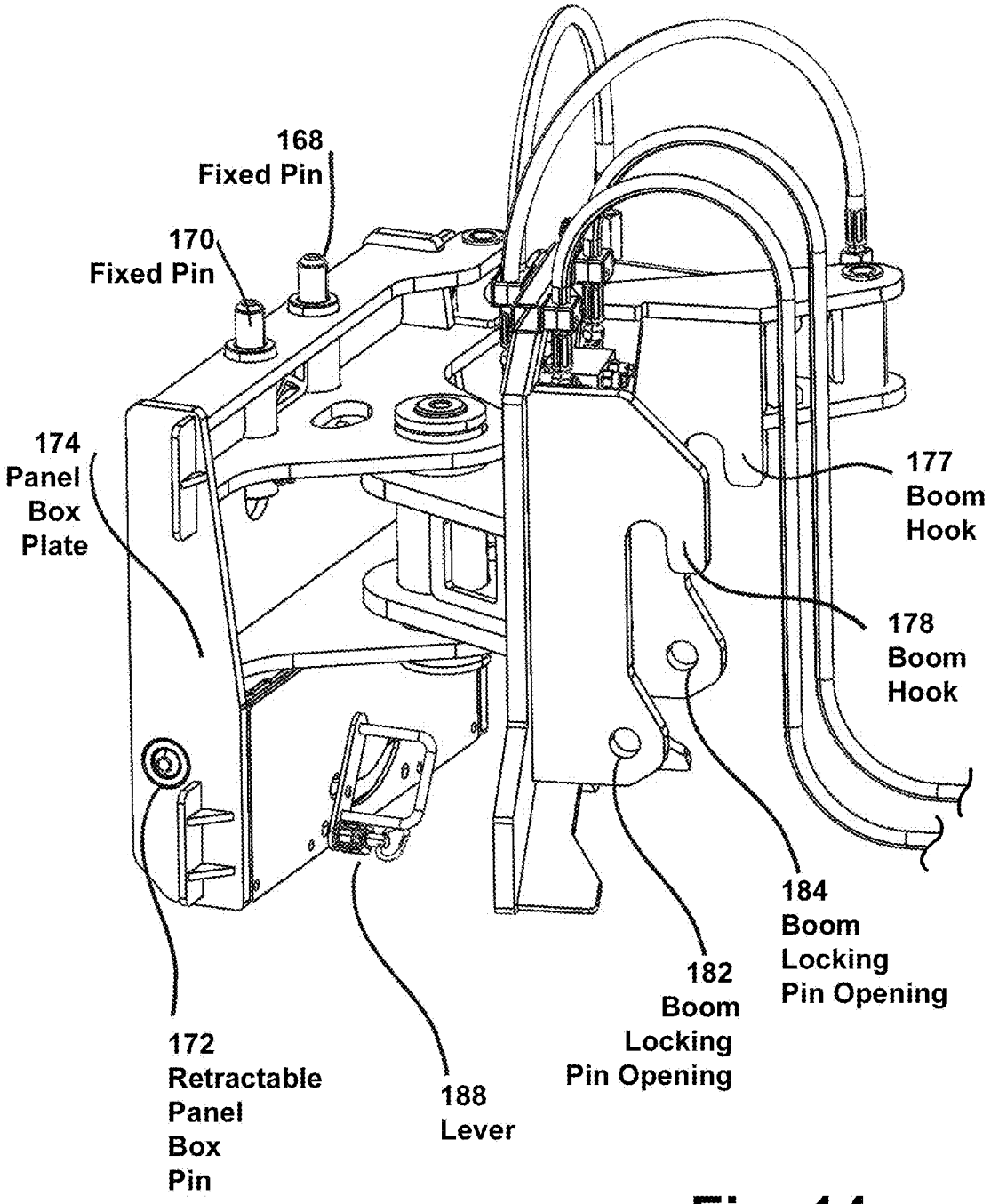
FIG. 14 is a schematic illustration of an embodiment of a lever for moving a panel box pin.

FIG. 13 is an elevated isometric view of a panel box attachment 135. The panel box attachment includes a panel box plate 174 that can swivel from left to right in response to a left-right pivot cylinder 186. The panel box plate 174 has a fixed pin 168 and a fixed pin 170. These fixed pins on the panel box plate are spaced apart to fit into the panel box pin holes illustrated in FIG. 9B. The panel box plate 174 also includes retractable panel box pin 171 and retractable panel box pin 172. The retractable panel box pins 171, 172 can be actuated manually with a lever as disclosed below. The retractable panel box pins 171, 172 are aligned with the distal panel box pin holes illustrated in FIG. 9B. The retractable panel box pins 171, 172 secure the panel box plate 174 in the panel box 134 illustrated in FIG. 9B. The panel box attachment 135 is connected to the boom using boom hooks 177 (FIG. 14), 178 and a boom locking pin (not shown) that fits through boom locking pin opening 182 and pin boom locking pin opening 184 (FIG. 14). The boom hooks 177, 178 and boom locking pin openings fit onto a standard connection on the boom so that the panel box attachment 135 can be easily connected to and disconnected from the boom. Hydraulic lines 176 are connected to the left/right pivot cylinder 186 to place the panel box plate 174 in the panel box 134 (FIG. 9B). The panel box plate 174 is placed in the panel box 134 and slid so the fixed pins 168, 170 slide into the openings, which are shown in FIG. 9B, as panel box pin holes 144, 146, 148, or 150. The boom is capable of moving the panel box plate 174 up and down, forward and backward, and rotating the panel box plate 174 in the axis of the boom. The left/right pivot cylinder 186 allows the panel box plate 174 to be pivoted in a left-right direction so that the panel box plate 174 can fit into the panel box 134, illustrated in FIG. 9B.

FIG. 14 is a back view of the panel box attachment 135. As illustrated in FIG. 14, fixed pins 168, 170 are mounted in a fixed position on the panel box plate 174. Lever 188 operates the retractable panel box pin 172 and retractable panel box pin 171 (FIG. 13). As shown in FIG. 14, the retractable panel box pin 172 is in a retracted position. FIG. 14 also illustrates the boom locking pin opening 182 and the boom locking pin opening 184. Boom hook 177 and boom hook 178 are also illustrated in FIG. 14.

Figure 15:
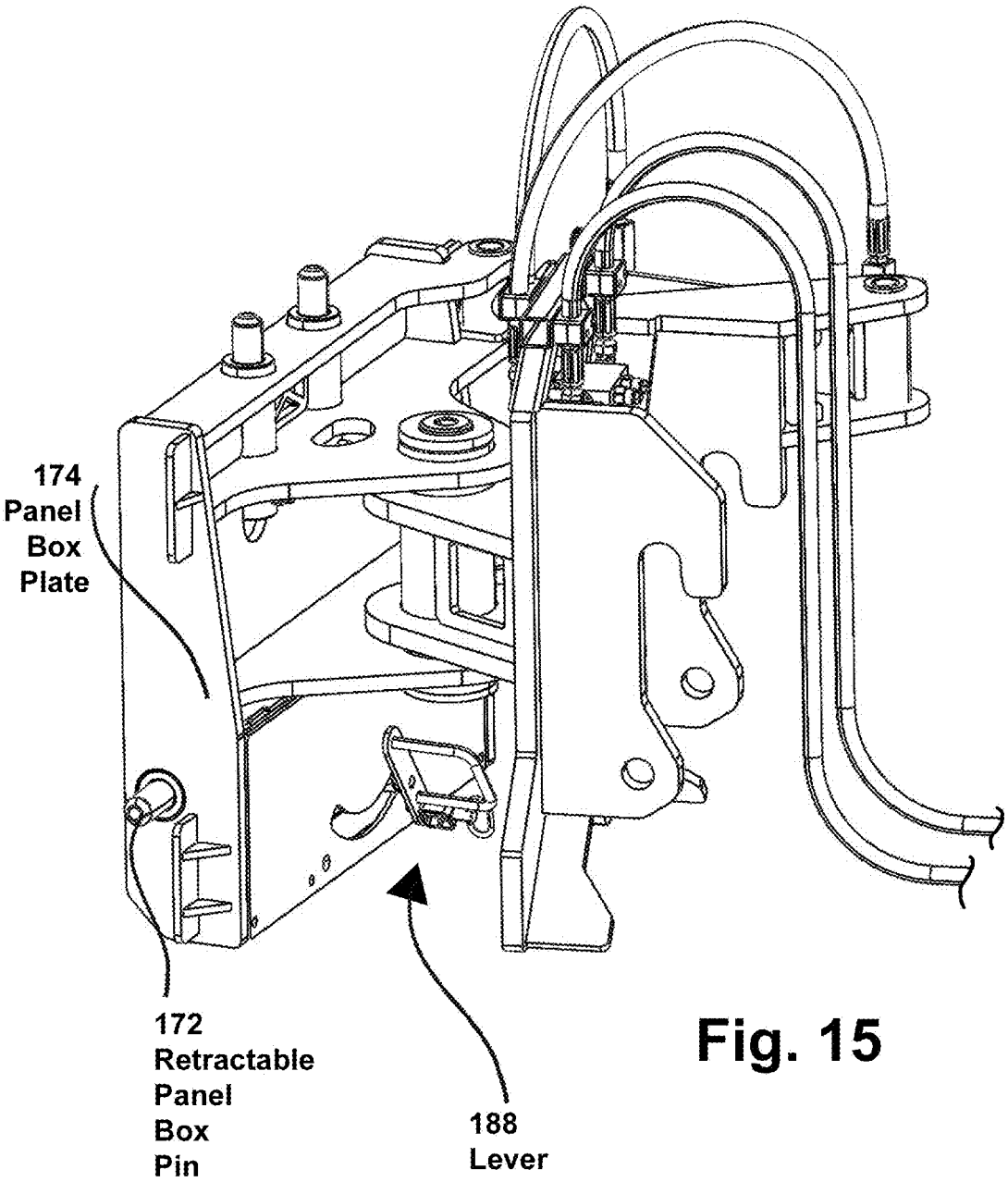
FIG. 15 is another illustration of an embodiment of a lever for moving a panel box pin.

FIG. 15 illustrates the lever 188 in a position so that the retractable panel box pin 172 is in the extended position. In this manner, the panel box plate can be locked into the panel box 134 (FIG. 9B). A lever 188 is manually operated to retract and extend the panel box pins 171, 172.

Figure 16:
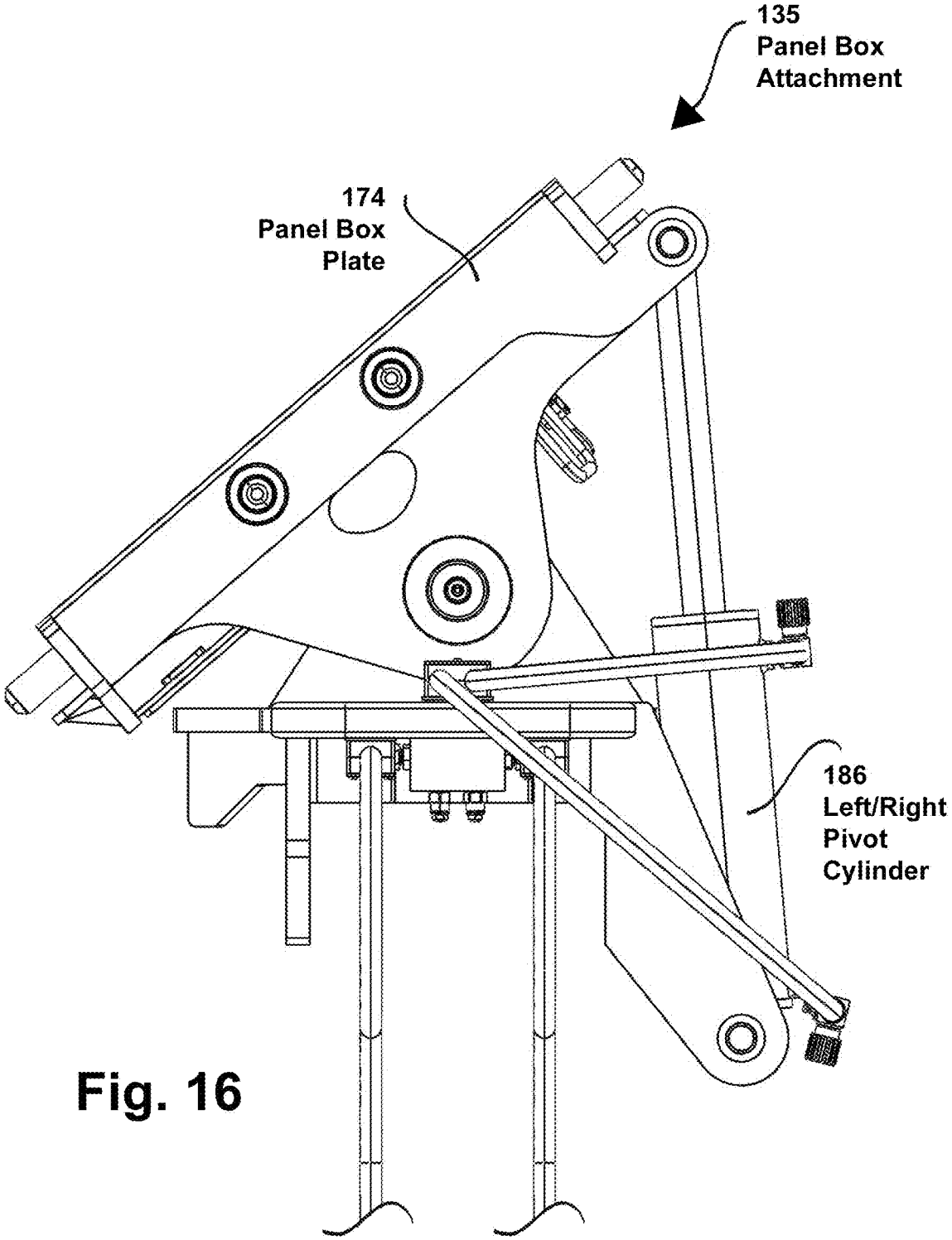
FIG. 16 is a schematic illustration of an embodiment of a panel box plate rotated in a counterclockwise direction.

FIG. 16 is a top view of the panel box attachment 135. The left/right pivot cylinder 186 is shown in an extended position so that the panel box plate 174 is rotated in a counterclockwise direction.

Figure 17:
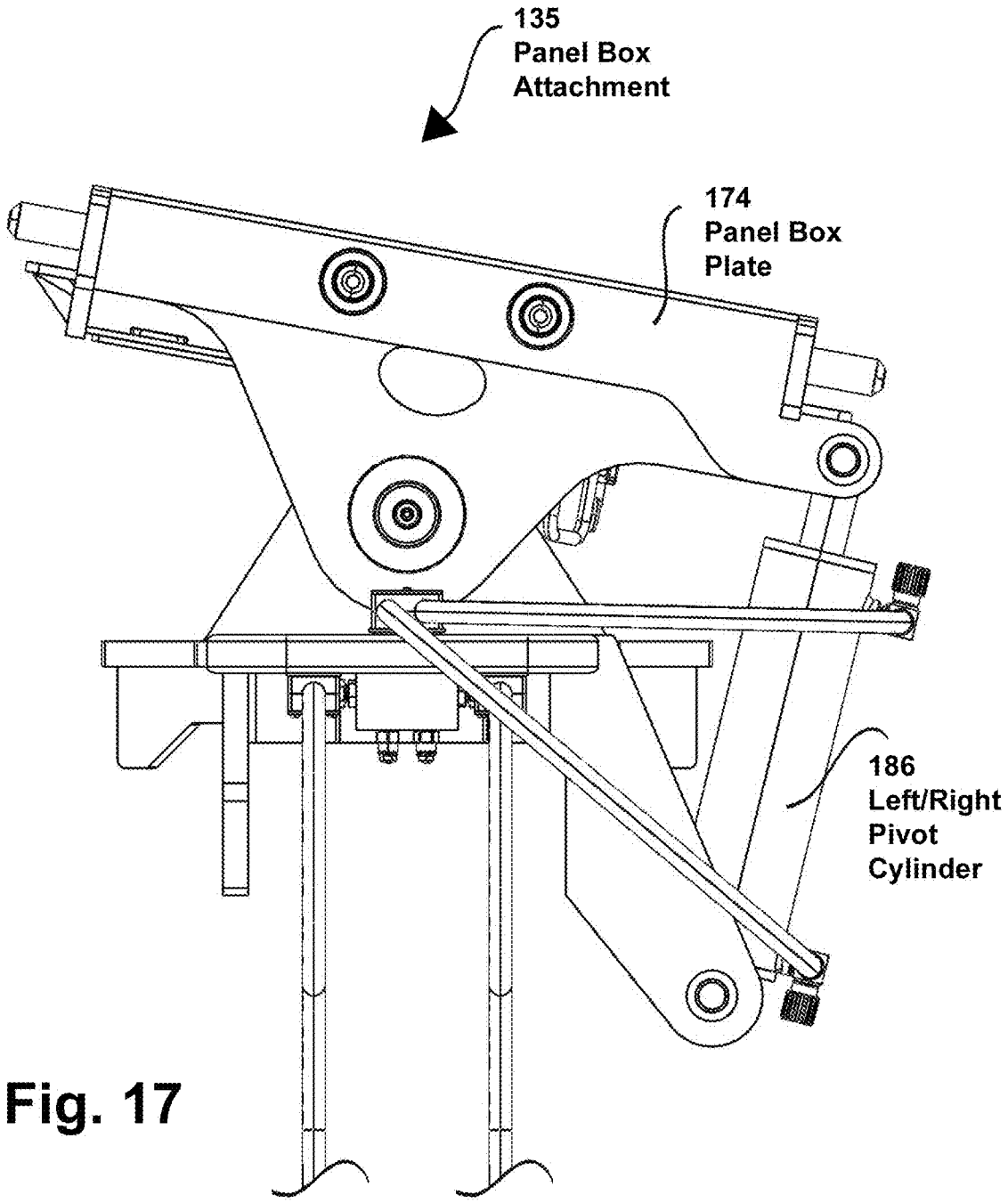
FIG. 17 is a schematic illustration of an embodiment of a panel box plate rotated in a clockwise direction.

FIG. 17 is a top view of the panel box attachment 135 with the left/right pivot cylinder 186 in a fully retracted position so that the panel box plate 174 is rotated all the way in a clockwise direction.

Figure 18:
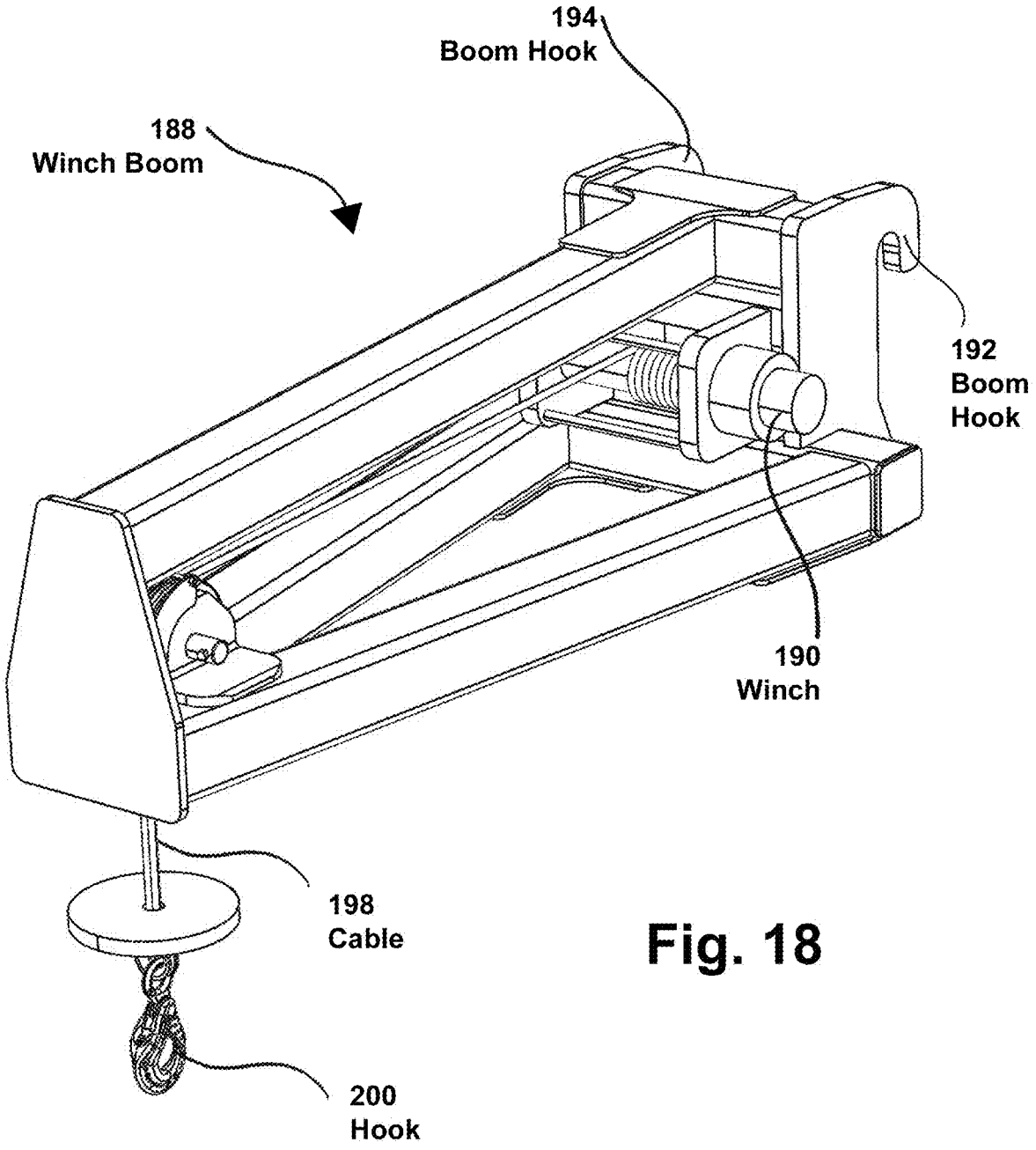
FIG. 18 is a schematic isometric view of an embodiment of a winch boom.

FIG. 18 is an isometric view of a winch boom 188 that is used to raise and lower the liner 110 and the tank wall 102. The winch boom 188 uses a standard connection for booms using boom hooks 192, 194. A hydraulic winch 190 is placed in the winch boom 188 and is attached to a cable 198 having a hook 200. The hook 200 hooks to a spreader bar which is then connected to the lifting straps on the liner 110, as disclosed in more detail in FIG. 19.

Figure 19:
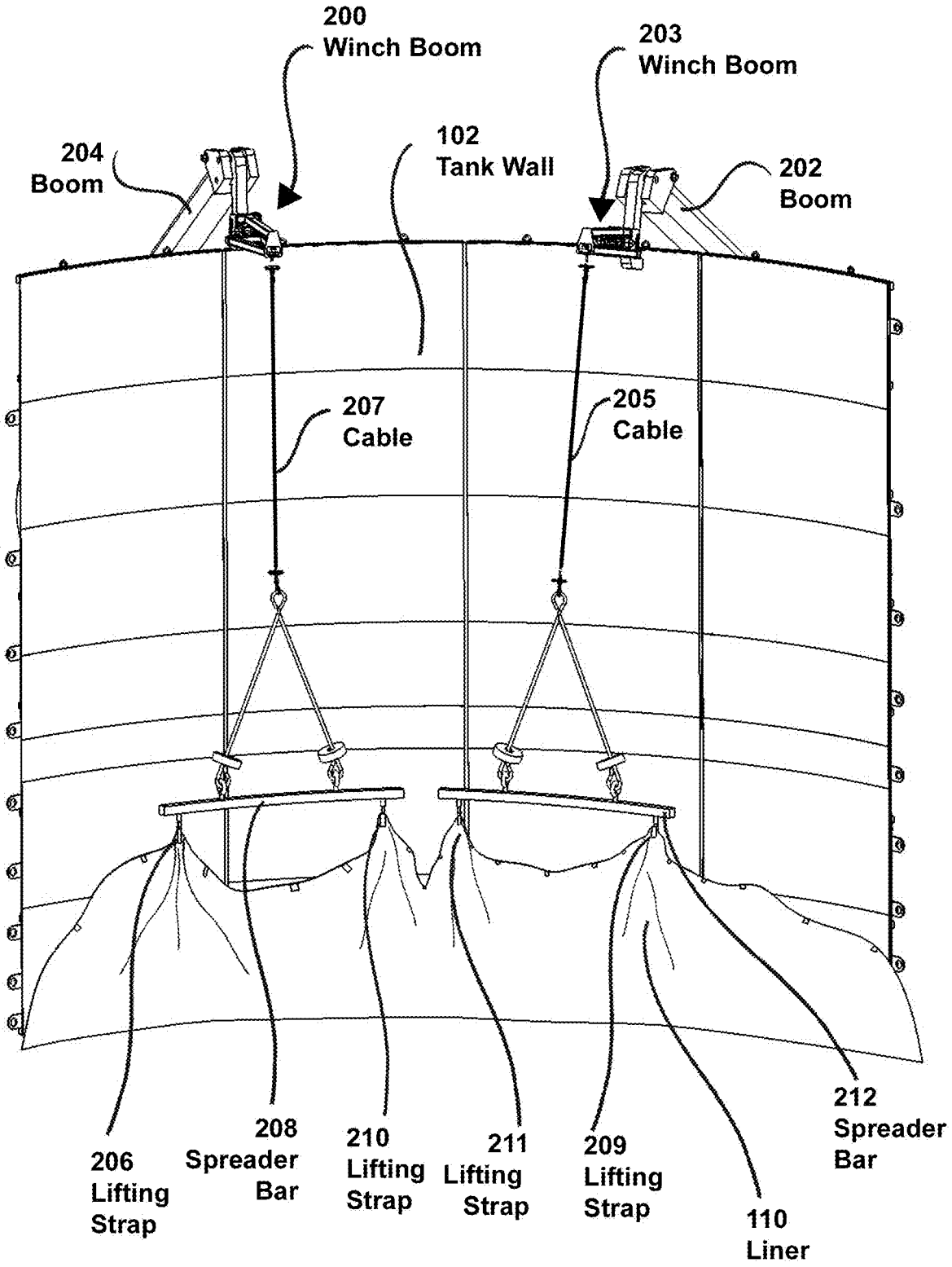
FIG. 19 is a schematic illustration of an embodiment of a liner being lifted by spreader bars inside of a tank.

FIG. 19 is a schematic illustration of the manner in which the liner 110 is raised on the tank walls 102. In accordance with this procedure, two booms 202, 204 are used to raise the liner 110. As illustrated in FIG. 19, boom 202 has a winch boom 203 which has a cable 205 that is connected to a spreader bar 212. Spreader bar 212 is connected to lifting strap 209 and lifting strap 211. Lifting straps 209, 211 are connected to an interior portion of the liner 110. Similarly, winch boom 200 is connected to boom 204 and has a cable 207 that is connected to the spreader bar 208. Spreader bar 208 is connected to lifting straps 206, 210. Winch boom 200 and winch boom 203 are activated simultaneously so that the liner is evenly pulled up the side of the tank wall 102 until it reaches the top and an exterior portion of the liner is then secured to the outside of the tank, as illustrated in FIG. 1.

Figure 20:
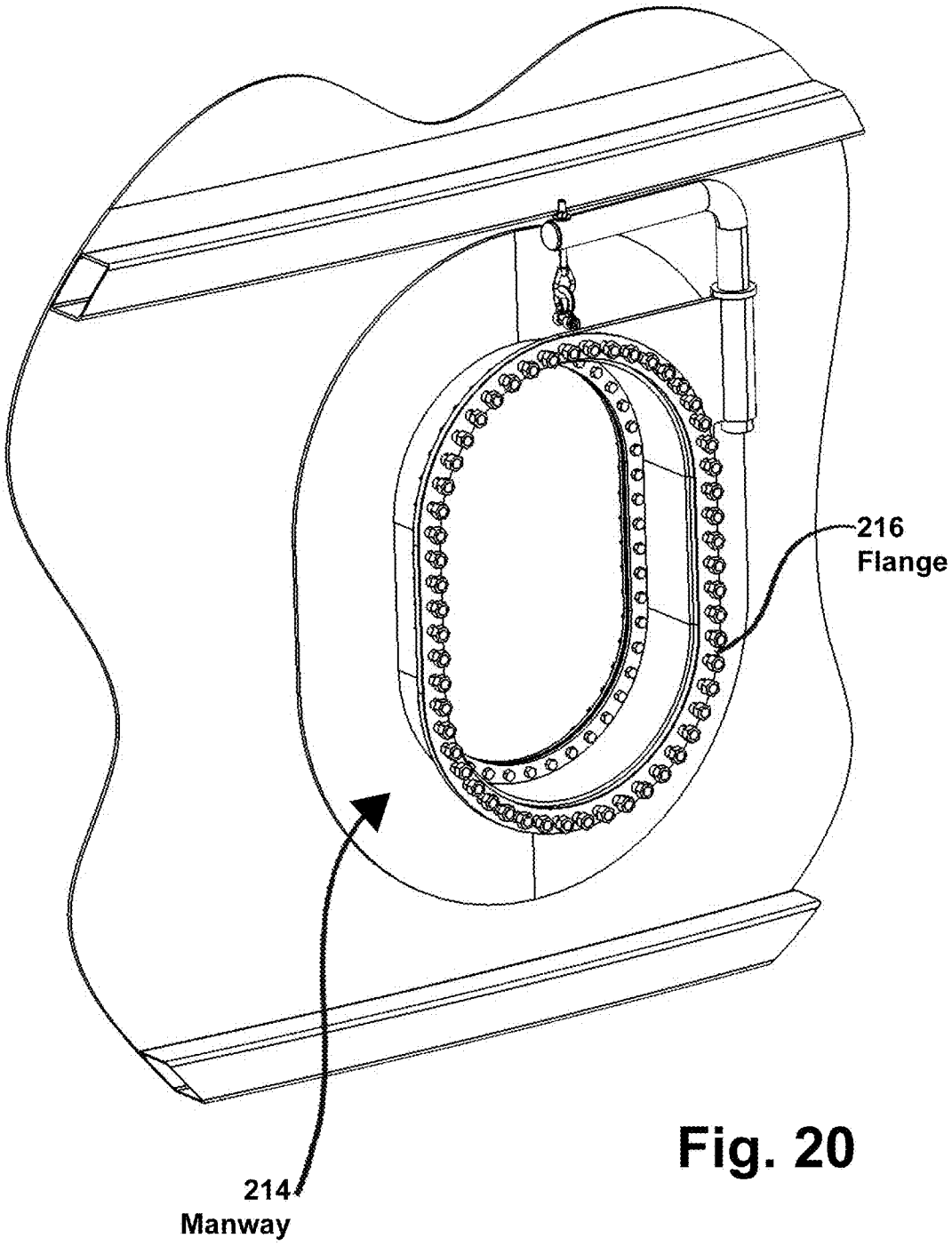
FIG. 20 is a schematic isometric view of an embodiment of a manway.

FIG. 20 is an illustration of a manway 214 that is formed in the side of one of the panels. The liner is secured to the inside of the manway 214 with a gasket. A door is then attached to the exterior portion of the manway 214, also using a gasket, to prevent leaks. The door is secured to the flange 216 on the manway 214 by tightly bolting the door to the flange 216.

The present invention therefore provides an easily constructed tank for retaining fluid that allows fluid to be transmitted into and removed from the tank 100 in a safe and easy manner. Fracking chemicals can also be added to water using one of the connectors of the manifold to create a fracking fluid. A series of panels can be easily lifted and placed in a proper position and connected together using connector plates that safely and easily secure the panels to form a tank wall. This can be done in a simple and rapid manner and then disassembled in a rapid manner for subsequent use. The liner is lifted using lifting straps and booms and the liner is secured using securing straps on the outside of the tank wall. The securing straps can be disconnected and the liner collapsed within the tank walls for subsequent use. Unique panel box attachments are used to allow each of the panels to be lifted using panel boxes that are located at the center of gravity of each of the panels which allows the panels to be lifted and transported in any orientation. Winch booms that use standard fittings for a boom are also used to lift and lower the liner in a simple and easy fashion.

The foregoing description of the invention has been presented for purposes of illustration and description. It is not intended to be exhaustive or to limit the invention to the precise form disclosed, and other modifications and variations may be possible in light of the above teachings. The embodiments were chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A system for connecting to, lifting and disengaging from a tank panel using a panel box attachment that attaches to a panel box on said tank panel comprising:

a panel box plate on said panel box attachment;

at least two fixed pins extending from said panel box plate that are configured to be inserted in a first set of panel box pin holes in said panel box;

at least two retractable pins that are configured to extend outwardly from said panel box plate to engage a second set of panel box pin holes in said panel box and retracted to a position in said panel box plate to disengage said at least two retractable pins from said second set of panel box pin holes;

a pivot cylinder that is attached to said panel box plate that pivots said panel box plate;

hydraulic lines connected to said pivot cylinder that is configured to move said panel box plate so that said at least two fixed pins are aligned with and engage said first set of panel box pin holes and said at least two retractable pins, are aligned with, and engage said second set of panel box pin holes in said panel box to secure said second panel box plate to said panel box.

2. The system of claim 1 wherein said panel box is located at the center of gravity of said tank panel.

3. The system of claim 1 further comprising:

boom hooks configured to attach to a boom;

boom locking pins that go through boom locking pin openings so that said panel box attachment is configured to connect and disconnect from said boom.

4. A panel box attachment configured to attach to a panel box located on a panel of a tank for storing fluids comprising:

a panel box plate having a top side, a bottom side, a left side, and a right side, so that said top side and said bottom side are opposite from each other and said right side and said left side are opposite from each other;

a left right pivot cylinder connected to said panel box plate configured to pivot said panel box plate;

at least two fixed pins that protrude from said top side of said panel box plate;

a first retractable panel box pin that protrudes from said left side of said panel box plate;

a second retractable panel box pin that protrudes from said right side of said panel box plate;

hydraulic lines connected to said left right pivot cylinder that are configured to move said panel box plate so that said fixed pins, said first retractable panel box pin, and said second retractable panel box pin are aligned with and disposed in corresponding panel box pin holes located on said panel box of said panel of said tank, and said boom configured to move said panel box plate in directions up and down, forward and backward, rotating along axis of said boom, and pivot in left and right directions.

5. The panel box attachment of claim 4 further comprising:

a lever configured to move said first retractable panel box pin and said second retractable panel box pin so that said first retractable panel box pin and said second retractable panel box pin are configured to secure said panel box attachment to said panel box of said panel of said tank, and said panel box is located at the center of gravity of said panel.

6. The panel box attachment of claim 4 further comprising:

boom hooks configured to attach to a boom;

boom locking pins that go through boom locking pin openings so that said panel box attachment is configured to connect and disconnect from said boom.

* * * * *